US007449840B2

(12) United States Patent
Mayer et al.

(10) Patent No.: US 7,449,840 B2
(45) Date of Patent: Nov. 11, 2008

(54) IGNITOR TURN-OFF SWITCH FOR HID BALLASTS

(75) Inventors: Thomas Mayer, Wisconsin Dells, WI (US); Glenn Garbowicz, Algonquin, IL (US)

(73) Assignee: Varon Lighting Group, LLC, Elmhurst, IL (US)

( * ) Notice: Subject to any disclaimer, the term of this patent is extended or adjusted under 35 U.S.C. 154(b) by 109 days.

(21) Appl. No.: 11/460,060

(22) Filed: Jul. 26, 2006

(65) Prior Publication Data

US 2007/0024215 A1 Feb. 1, 2007

Related U.S. Application Data

(60) Provisional application No. 60/702,401, filed on Jul. 26, 2005.

(51) Int. Cl.
*H05B 37/02* (2006.01)

(52) U.S. Cl. ..... 315/209 R; 315/307; 315/360

(58) Field of Classification Search ..... 315/200 R, 315/209 R, 224, 209 M, 246, 291, 307, 360, 315/362, 209 T
See application file for complete search history.

(56) References Cited

U.S. PATENT DOCUMENTS 3,681,653 A 8/1972 Snyder
4,258,295 A 3/1981 Siglock
4,591,781 A 5/1986 Larson
4,896,077 A 1/1990 Dodd et al.
4,962,336 A * 10/1990 Dodd et al. ..... 315/290
4,996,464 A * 2/1991 Dodd et al. ..... 315/289
5,070,279 A * 12/1991 Garbowicz et al. ..... 315/289
5,424,617 A 6/1995 Garbowicz et al.
5,442,261 A * 8/1995 Bank et al. ..... 315/307
5,801,494 A 9/1998 Herres et al.
5,945,784 A 8/1999 Mattas
6,127,782 A 10/2000 Flory, IV et al.
6,429,597 B1 8/2002 Flory, IV et al.
6,639,777 B1 10/2003 Congdon
6,642,673 B2 * 11/2003 Hudson et al. ..... 315/290
6,731,073 B2 5/2004 Van Veldhuizen

* cited by examiner

*Primary Examiner*—Thuy Vinh Tran
(74) *Attorney, Agent, or Firm*—Levenfeld Pearlstein; Mitchell J. Weinstein; Marc E. Fineman

(57) ABSTRACT

The instant invention relates to an ignitor turn-off switch for ballasts for high intensity discharge (HID) lamps to prevent damage to ballasts by disconnecting the ignitor if a lamp has failed or is missing. The ignitor turn-off switch circuit comprises an AC power source, a full-wave bridge rectifier circuit, a voltage regulator circuit, a first solid state integrated circuit as a timer circuit, and a second solid state integrated circuit as a switch circuit. The second solid state integrated circuit comprises an optically-coupled triac and light emitting diode wherein the optically-coupled triac is driven by a beam generated by the light emitting diode.

3 Claims, 3 Drawing Sheets

IGNITOR TURN-OFF SWITCH FOR HID BALLASTS

FIELD OF THE INVENTION

This application claims the benefit of U.S. Provisional Patent Application No. 60/702,401 filed on Jul. 26, 2005.

The invention relates generally to ignitor turn-off switches for high intensity discharge (HID) lamps and for HID ballasts, particularly of types including CWA, HX, and reactor-style ballasts, and PSMH (pulse start metal halide) and HPS (high pressure sodium) lamps and ballasts.

BACKGROUND OF THE INVENTION

High intensity discharge (HID) lamps are used in many applications because of their long life and high efficiency. Principal types of HID lamps are high pressure sodium (HPS), pulse start metal halide (PSMH), and mercury vapor lamps.

Mercury vapor, metal halide, and HPS lamps all operate similarly during stabilized lamp operations. The visible light output results from the ionization of gases confined within an envelope and which must be broken down before there is any flow of ionization current. Accordingly, a high open circuit voltage must be applied to an HID lamp for igniting. This voltage is substantially higher than the operating voltage and the available line voltage.

HID lamps also exhibit negative resistance. When operating, their resistance decreases with increase in the applied voltage. As a result, such lamps require an impedance means in their power supply to limit the alternating current flow to a predetermined value.

Because of the high starting or igniting voltage requirement and the negative resistance characteristic, HID lamps are provided with igniting and operating circuits, which provide a relatively high open circuit voltage and impedance means for current limitations. A ballast between the power supply and lamp typically serves as its impedance means in igniting and operating circuits for HID lamps. For HID lamps such as mercury vapor lamps, igniting voltages can be two times the operating voltage. The igniting voltage is generated by the ballast acting in conjunction with a capacitor. For high pressure sodium (HPS) lamps, the required voltages can be more than ten times the operating voltages and more complex igniting mechanisms are employed.

The ballast system also typically provides for certain requirements when electronic ignitors are used in conjunction with the HID lamps. For example, electronic ignitors used in conjunction with high pressure sodium (HPS) ballast coils produce a high voltage pulse to start the HPS lamp. These electronic ignitors work by sensing whether the lamp is burning or not. If the lamp is not burning, the ignitor continuously supplies starting pulses to the lamp, regardless of whether the lamp is not burning because of lamp failure, absence of a lamp in the lamp socket, or by the lamp "cycling off."

Lamp cycling is a well-known phenomenon in which a lamp nearing the end of its life will light, turn-on for some time, go out, relight, and repeat this cycle time after time until the lamp is replaced or the lamp will fail to start at all. In an HPS lamp, as the HPS lamp nears the end of its life, its lamp operating voltage gets so high that the ballast will no longer sustain operation, and the lamp cycling condition manifests itself.

From the foregoing, it is clear that certain problems can arise in the operation of HID lamps and associated ballasts. In certain situations, e.g., when a lamp is cycling, has failed or is missing, the ignitor in the lamp's HID circuit continues to operate. Such operation shortens ignitor life, especially in cases where the ignitor operates in conjunction with the ballast so that more than normal power is drawn by the ballast transformer. The result of increased current drawn by the ballast transformer can be damaged ballasts by burning or smoking, damaged HID lamp fixtures, and wiring. Cycling lamps can be also avoid replacement by being "on" when inspected and thus cause future maintenance problems.

In view of the above, a number of devices have been developed as ignitor disablers for the starter circuit of a high intensity discharge (HID) lamp. The ignitor disabler circuit typically includes means for disabling the ignitor and means for triggering the disabling means after passage of a predetermined period of time.

U.S. Pat. No. 3,681,653 to Snyder teaches a lighting system for HID lamps for controlling the application of high voltage starting pulses of a capacitor to ignite an HID lamp wherein upon extinguishment of the lamp for any reason a gated bilateral switch is turned off to permit the pulsing circuit to apply a series of high voltage pulses to the lamp to re-ignite the lamp. After the lamp ignites, the circuit does not apply high voltage pulses across either the charging or pulsing capacitor or the switching device, since they are connected on the source sides of the system and not on the lamp side. Upon lamp failure, the charging or pulsing capacitor or switching device being on the source side are not subject to the high voltage pulses, thus prolonging the life of the components.

U.S. Pat. No. 4,258,295 to Siglock discloses a ballast circuit for a sodium vapor lamp wherein the circuit includes a ballast transformer, a high voltage oscillation circuit, and a time delay circuit for delaying the time the lamp starts after the power is turned on. The high voltage oscillation circuit utilizes a capacitor charged to a high potential across a transformer secondary and causes an diac to conduct, getting a triac to cause the triac to discharge the capacitor, to produce a high voltage pulse applied to the lamp to result in sodium ionization of its lamp. Once the sodium arc is formed, the low impedance load causes the voltage to drop to stop operation of the oscillator. A time delay switch circuit triggered by the initial voltage across the transformer primary delays the start-up process of the lamp for a period of time determined by the timer circuit. The time delay switch includes a triac gated by a photodiac triggered by light from a light emitting diode controlled by the timing circuit. A transformer provides power to the timing circuit through a bridge rectifier of four diodes to provide a DC voltage for the timing circuit and a voltage regulator, which may be a commercially available, type 7805 integrated circuit. Timing can be from zero to fifteen minutes based on the RC network connected to the integrated circuit.

U.S. Pat. No. 4,591,781 to Larson discloses a variable control circuit for varying the current to a load and, simultaneously, limiting the output of the load to a predetermined time interval. A timer chip receives rectified current from an AC voltage source. When the output of the timer chip is low at the end of the predetermined time interval, the controlled logic triac controls the flow of current to the load. The timer chip is a commercially available integrated circuit. An RC circuit connected to the timer chip determines the timing output of the chip. A Zener diode, a rectifier diode, series resistors, and a capacitor provide rectified current.

U.S. Pat. No. 4,896,077 to Dodd et al. teaches an ignitor disabler of an HID lamp that disables the ignitor when the characteristic voltage of the lamp exceeds an established AC threshold. The ignitor disabler includes a timing network, which is reset only when an excessive voltage is detected. The reset portion of the disabler includes a field effect transistor for discharging the timing network. The ignitor disabler operates as an HID lamp nears the end of the its life and the lamp operating voltage gets so high that the ballast will no longer sustain operation. The ignitor disabler increases the effective life of ignitors and ballasts.

U.S. Pat. Nos. 4,962,336 and 4,996,464 to Dodd et al. teach ignitor disablers with means for disabling the ignitor and means for triggering the disabling means of the ignitor after passage of a predetermined time. An AC threshold voltage is converted to a DC voltage.

U.S. Pat. No. 5,070,279 to Garbowicz et al. discloses an ignitor circuit for a discharge lamp controlled by a timer to shut off ignitor pulses after a predetermined time if the lamp does not ignite. The timer is controlled by the application of power to the input line and draws power from the output side of the ballast. Output voltage from an opto-isolator is applied to a triac gate when the opto-isolator switch closes. When the triac closes, the ignitor segment of the circuit can function.

U.S. Pat. No. 5,424,617 Garbowicz et al. discloses a ballast for powering a lamp load comprising a power source, an ignition means for generating ignition pulses based on the output voltage, a timing means for controlling when the ignition pulses are to be generated, and voltage sensing means for automatically sensing whenever the output voltage is insufficient for lighting the lamp load. The timing means includes a timing device and an opto-coupler, said opto-coupler being coupled between said timing device and a switching means across the lamp load. The switching means includes a triac having a gate connected to said opto-coupler.

U.S. Pat. No. 5,801,494 to Herres et al. discloses a single, integrated circuit combining both a restrike ignitor and a digital timer circuit, which generates high voltage pulses for starting and restarting high intensity discharge lamps.

U.S. Pat. No. 5,945,784 to Mattas discloses a ballast for an HID lamp, which includes an ignitor and a resonant circuit. The circuit is disabled after a predetermined time following ignition of the lamp.

U.S. Pat. Nos. 6,127,782 and 6,429,597 to Flory, IV et al. disclose an ignitor and ignitor-monitoring device, which is externally mounted to the HID luminaire.

U.S. Pat. No. 6,639,777 to Congdon discloses that timer switches are commonly used to connect the load to the input voltage and suspend the reapplication of power to the load. A timer switch can be used to prevent over-stress to an HID lamp ignitor.

U.S. Pat. No. 6,642,673 to Hudson et al. discloses an ignition disabling circuit wherein a timer circuit generates a timing signal after a selected period of time to disable an ignitor circuit wherein a triac can be opened to cause the ignitor to cease operating.

U.S. Pat. No. 6,731,073 to Van Veldhuizen discloses an automatic starter for fluorescent lamps that includes a timer switch and an electronic timer coupled to the timer switch that prevents the after-glow from continually striking a lamp that has failed. The timer is a solid state timer. The lamp starter circuit incorporates the series arrangement of a glow switch and a semi-conductor switch, the semi-conductor switch being coupled to the solid state timer.

Accordingly, in the prior art, it is known to provide a gated bilateral switch, which is turned off to permit a pulsing circuit to apply high voltage pulses to a lamp to re-ignite an HID lamp using a pulsing capacitor or a switching device on the source side of the system, not on the lamp side. Also, it is known to use a high voltage oscillator to cause a diac to conduct, gating a triac to cause a capacitor to produce a high voltage pulse to an HID lamp. A time delay switch circuit staggers the start-up process of the HID wherein the time delay switch includes a triac gated by a photodiac. A voltage regular circuit comprising an integrated circuit is part of the circuit.

Known circuits in the prior art teach disablers for disabling ignitors in HID lamp monitors. The disablers conventionally are included in the ballast circuiting and the ignitor component as part of the total assembly, the disabler circuitry including a timer and cutoff switch. Known solid state timing devices and circuitry are used in conjunction with gated triacs as control elements as well as opto-couplers and integrated circuitry.

SUMMARY OF THE INVENTION

This invention relates to a novel ignitor turn-off switch for HID ballasts designed to automatically disconnect the ignitor after specified minutes, if the lamp is missing or the lamp fails to automatically reset as an ignitor turn-off switch operates after brief power interruptions wherein the ignitor turn-off switch input operating circuit is connected to the power source side of the ballast and its control output is between the lamp and the ignitor on the lamp side of the ballast. The ignitor turn-off switch for HID ballasts comprises four basic components: (a) a constant voltage direct current power supply, (b) a direct current voltage regulator to protect the components of the ignitor turn-off switch, (c) a timer circuit comprising a solid state integrated timer circuit, and (d) a solid state integrated switch circuit comprising an optically coupled triac and a light emitting diode (LED) such that when the gate of the triac is driven by a beam of light generated by the LED, an On/Off switch function is realized at the output of the ignitor turn-off switch to the ignitor, as the controlling switch for the ignitor.

In operation, upon application of a DC voltage to the LED of the solid state integrated switch circuit, the LED generates a beam of light to cause its optically coupled triac to be active to turn-on to close the switch to turn-on. Upon removal of the DC voltage to the LED of the solid-sate integrated switch circuit, the beam of light is deactivated to open the switch. The removal and reapplication of power to the timer circuit by application of power to the constant current power supply component of the ignitor turn-off switch causes the timing cycle to be repeated.

In the application of the solid state ignitor turn-off switch of this invention, the solid state ignitor switch draws power from the current input side of the ballast and thus is isolated from the ballast. Therefore, no high voltage pulses are applied to any component of the ignitor switch, since they are connected to the source side of the system and not on the lamp side. Furthermore, after the HID lamp ignites, no voltage is applied because of the timer circuit to any of the components of the solid state ignitor switch during the long operation of the lamp itself. Increased life of the components is realized thereby increasing the life and reliability of the lighting system.

DESCRIPTION OF THE DRAWINGS

In FIG. 1, J3 is the line input for 277 VAC, J2 is the line input for 120 VAC, J1 is the line input common, and J4 and J5 comprise the ignitor turn-off switch S1 output of 250 mA (max) and 800V P/P (max).

In FIG. 2, the components of the constant current power supply are C1*a*, C1*b*, ZNR, D1-D4, C2; voltage regulator components are Q1, R1, Z1; timer components are IC1, R2, R3, C3, C4, C5; AC switch components are IC2, R4.

In FIG. 3, the 120 VAC lead on the primary of the ballast transformer is connected to J2 input lead of turn-off switch S1, the black lead. The two red output leads of S1 are J4 and J5. The white input lead is common input lead J1. The ignitor is connected to the secondary of ballast transformer and across input to the lamp through turn-off switch S1, and red leads J4 and J5.

In FIG. 3, the 277 VAC lead on primary of ballast transformer is connected to yellow lead J3 input lead of turn-off switch S1; the two red output leads, J4 and J5, are connected to the ignitor and the lamp; the white input lead J1 is connected to the line input common.

DETAILS OF THE INVENTION

Figure 1:
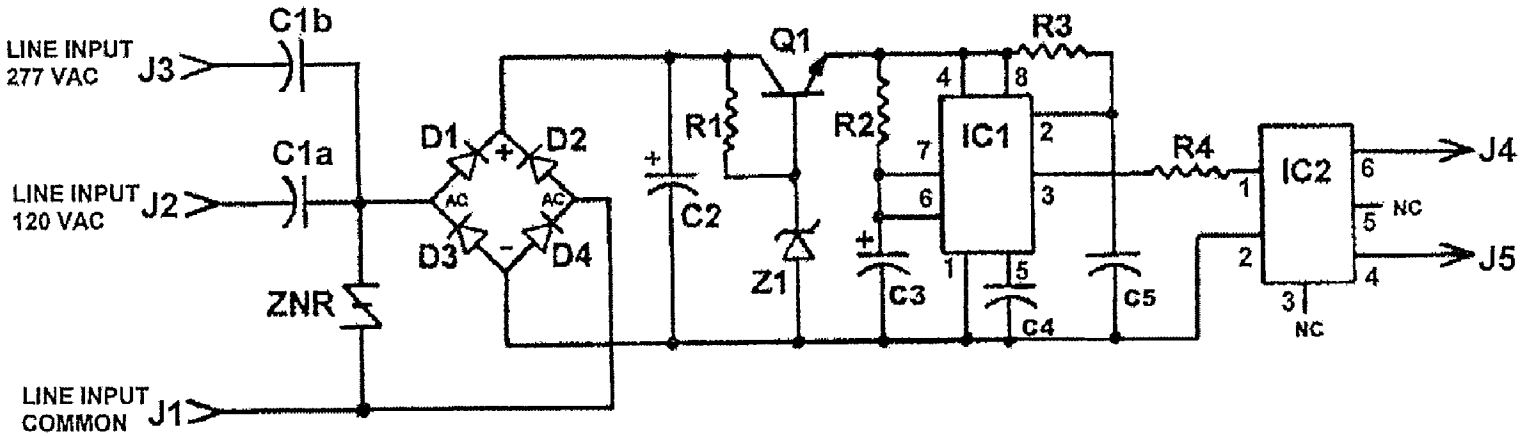
FIG. 1 is a schematic diagram of the ignitor turn-off switch of the invention.
Figure 2:
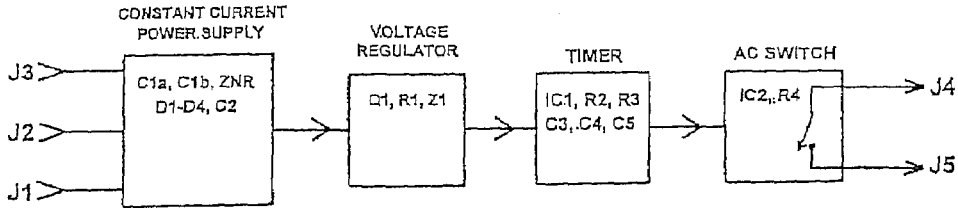
FIG. 2 is a simplified block diagram of the ignitor turn-off switch of the invention.
Figure 3:
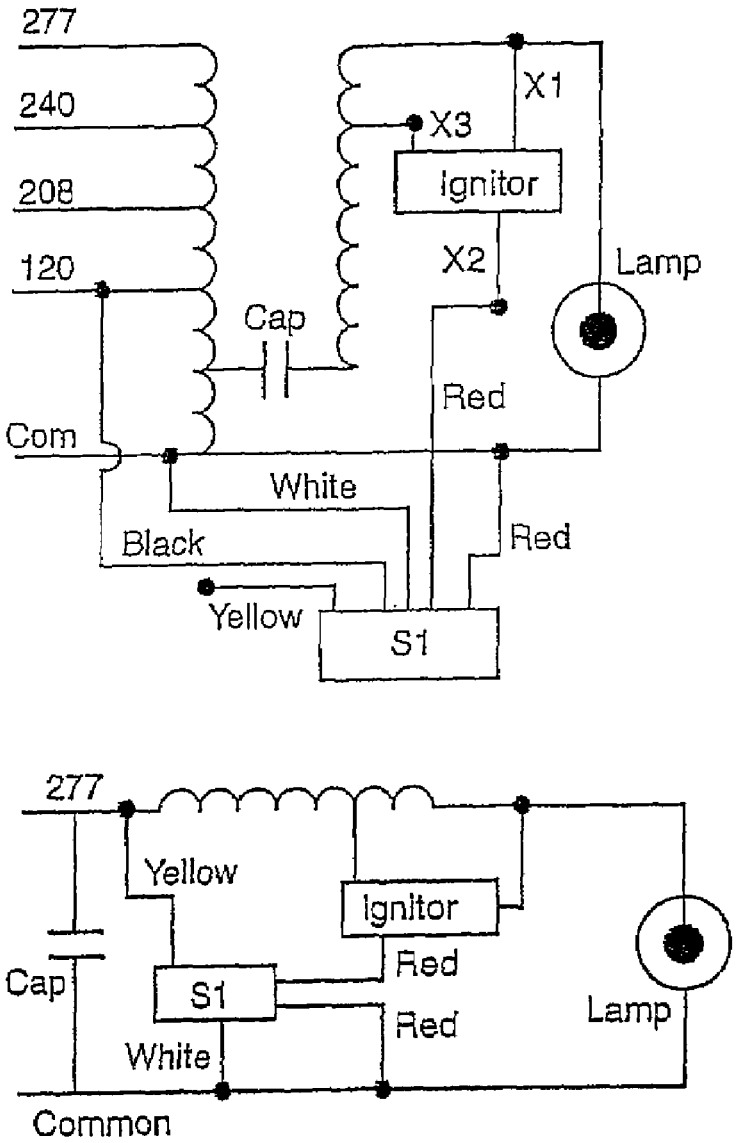
FIG. 3 illustrates two igniting and operating wiring circuits for an HID lamp including therein an ignitor, the ignitor turn-off switch, and the ballast wherein the input terminals of the ignitor turn-off switch S1 are connected to the input terminals of the CWA, HX, and reactor-style ballasts (277-120 VAC) and output terminals of the ignitor turn-off switch are connected to the ignitor and to the lamp operating circuit.

In the instant invention, the control of the operating voltage of the ignitor turn-off switch is an essential element. The values of the constant current power supply current limiting capacitors are selected to limit maximum current flow available to the bridge circuit of the turn-off switch, a bi-directional AC Zener shunts excess voltage when the Zener voltage rating has been reached basis the conjoined current limiting capacitors in the constant current power supply. In the voltage regulator circuit, an NPN transmitter and resistor in connection with a Zener diode form a series pass voltage regulator of the voltage regulator circuit output. The resulting level of the power supply voltage to the first solid state integrated (timer) circuit is sensed at the timing pins of the first solid state integrated (timer) circuit to activate and deactivate the second solid state integrated (switch) circuit. The level of the power supply voltage to the solid state integrated (switch) circuit provides current to the LED contained in the second solid state integrated (switch) circuit. A resistor limits the current made available to the LED. Upon removal of DC voltage to the second solid state integrated (switch) circuit, the optically coupled triac contained in the second solid state (switch) circuit is deactivated and the switch is open (off). By the removal and reapplication of power to the first solid state integrated (timer) circuit by application of power to the input terminals of the ignitor turn-off switch, the timing cycle of the ignitor turn-off switch is repeated.

The theory of operation of the four basis components of the ignitor turn-off switch follows in a detailed explanation of the operation of each component.

The details of the constant current power supply are as follows:

The constant current power supply receives Mains supply voltage via common input terminal J1 and either input terminal J2 (when operating on 120 VAC Mains) or J3 (when operating on 277 VAC Mains), and where the Mains voltage provided at input terminals J1 and J2 (or J1 and J3) are passed through current limiting capacitor C1*a* (120 VAC) or C1*b* (277 VAC) to rectifier bridge comprised of rectifier diodes D1-D4. The value of C1*a* and C1*b* are chosen to limit the maximum current flow available to rectifier bridge D1-D4, providing the appropriate amount of energy necessary to power the remainder of the circuit. ZNR is a bi-directional AC Zener that begins to shunt excess voltage when the Zener voltage rating has been reached. The ZNR is placed across the input terminals of the rectifier bridge D1-D4 in order to limit the AC voltage available to the bridge. The combination of C1*a*, C1*b* and ZNR form a crude constant current supply. The resulting DC voltage made available at the positive and negative terminals of rectifier bridge D1-D4 and is smoothed by filter capacitor C2.

The details of the voltage regulator are as follows:

The DC voltage at the positive and negative terminals of filter capacitor C2 is impressed upon the remainder of the circuit through a series pass voltage regulator, where the negative terminal of the filter capacitor C2 is connected to the remainder of the circuit and shall be referred to as the supply common. The DC voltage at the positive terminal of filter capacitor C2 is connected to the collector of an NPN transistor Q1 and resistor R1. The base of NPN transistor Q1 is connected to resistor R1, which serves to forward bias (turn on) transistor Q1, and is also connected to the anode of Zener diode Z1 forming a series pass voltage regulator. The DC voltage supplied to the collector of transistor Q1 is passed through the transistor and made available to the remainder of the circuit via transistor Q1 emitter.

As the input voltage at the collector of Q1 increases, so, too, does the voltage at the base and emitter of transistor Q1 (as a result of resistor R1) until the voltage on the anode of Zener Z1 is reached, as referenced to common. At the desired Zener voltage, Zener Z1 begins to conduct energy preventing the base of transistor Q1 from rising above that set by the Zener. At this point, the output voltage at the emitter of transistor Q1 is limited to that of the Zener voltage, forming a series pass voltage regulator.

The details of the timer circuit are as follows:

The Timer Circuit is comprised of a first solid state timer integrated circuit IC1. Positive voltage is supplied to IC1 via terminals #4 and #8. Resistor R2 and capacitor C3 are connected in series, where one side of resistor R2 is connected to the positive voltage supply and one side of capacitor C3 is connected to the negative of the power supply forming an R/C timing circuit. The common connection of resistor R2 and capacitor C3 terminates at the timing pins #6 and #7 of timer IC1.

When voltage is applied to timer IC1, resistor R2 begins charging capacitor C3. (The timing period is determined by the rate at which C3 charges). During this initial timing period, the output of timer IC1 (terminal #3) is high, providing a DC voltage to second solid state switch integrated circuit IC2 via current limiting resistor R4 and power supply common. Timing capacitor C3 continues to charge (via timing resistor R2) until the voltage across C3 at timer IC1 pins #6 and #7 approaches ⅔ that of the power supply voltage. When ⅔ the power supply voltage is sensed at timing pins #6 and #7 of IC1, the output at terminal #3 of IC1 is turned off, deactivating solid state switch IC2.

Timer IC1 requires a trigger or start signal. This is accomplished during application of power at input terminals of the power supply via trigger pin #2 of IC1. This trigger terminal must be momentarily held at a low voltage potential (less that ⅓ of the power supply voltage) upon application of power. Capacitor C5 and resistor R3 accomplish this, due to the fact that capacitor C5 is initially in a state of discharge, holding pin #2 at ground (common) potential. Resistor R3 slowly charges capacitor C5 after the timing cycle has been initiated, which prevents any additional trigger signals at pin #2 of IC1.

Capacitor C4 aids in the start-up of IC1, ensuring that timing cycle begins during application of power at Mains terminals J1, J2 and J3.

Upon completion of timing cycle, pin #3 of IC2 is de-activated and will not re-activate until timer circuit is reset by the removal of power supply input voltages and capacitor C5 has discharged.

The details of the solid state switch are as follows:

IC2 represents a Solid State Switch in the form of an optically coupled (electrically isolated) triac or AC switch, where pins #1 and #2 of IC2 provide power to a Light Emitting Diode (LED), and pins #4 and #6 are connected internally to Main Terminal 1 (MT1) and Main Terminal 2 (MT2) of a triac. The gate of the triac contained within IC2 is driven by a beam of light generated by LED, also contained within IC2.

Upon application of a DC voltage at pins #1 and #2 of IC2 (the LED), triac within IC2 is forced active (turned On), and an On/Off switch function is realized at pins #4 and #6. When wired in series configuration, Pins #4 and #6 become the controlling means or switch for HID starter or other similar device. Resistor R4 serves to limit the current made available to LED contained in IC2 at pins #1 and #2. Upon removal of DC voltage at pins #1 and #2 of IC2, the triac is deactivated, and the switch is open (off). The removal and reapplication of power to the timer circuit via terminals J1 and J2 or J3, the timing cycle is repeated.

The solid state integrated (timer) circuit IC1 is a standard type 8-pin timer integrated circuit, LM555N. The solid state integrated (switch) circuit IC2 is a standard type 8-pin MOC3802 800V triac driver. The Zener ZNR is an 18 v AC Zener, a standard type, Panasonic P/N ERZ-V05D180.

The details of the parts of the instant invention are as follows:

IGNITOR TURN-OFF SWITCH

| QTY | PART | DESCRIPTION |
|---|---|---|
| 1 pc | R1 | 2.2K ¼ w 5% Resistor |
| 1 pc | R2# | 3.3M ¼ w 5% Resistor |
| 1 pc | R3 | 1.0M ¼ w 5% Resistor |
| 1 pc | R4 | 240 ¼ w 5% Resistor |
| 1 pc | C1a (120 v) | .68 mfd 250 vdc Mylar Capacitor |
| 1 pc | C1b (277 v) | .27 mfd 630 vdc Mylar Capacitor |
| 1 pc | C2 | 10 mfd 50 vdc Electrolytic |
| 1 pc | C3 | 100 mfd 16 vdc Electrolytic |
| 1 pc | C4 | .01 mfd 50 vdc Mylar Capacitor |
| 1 pc | C5 | .047 mfd 50 vdc Mylar Capacitor |
| 4 pc | D1-D4 | 1N4007 Diode |
| 1 pc | Z1 | 6.8 v 500 mw Zener 1N5235B |
| 1 pc | Q1 | 2N4401 NPN Transistor |
| 1 pc | IC1 | LM555N Timer |
| 1 pc | IC2 | MOC3082 800 v Triac Driver |
| 1 pc | ZNR | 18 v AC Zener<br>Panasonic P/N ERZ-V05D180 |

Notes:
(1) R2# determines clock time-out. 3.3M = 7-8 minutes.
(2) C1a and C1b determine input operating voltage.
(3) Timer Reset Time <120 ms.
(4) Input denotes C1a and C1b.

In summary, the instant invention comprises an ignitor turn-off switch circuit for use with CWA (constant wattage auto-transformer), HX (high reactance auto-transformer), and reactor-style ballasts comprising, in combination: (a) an AC power source, (b) a full-wave bridge rectifies circuit across said AC power source to convert AC line voltage to pulsating DC output voltage to provide a constant DC current power supply, (c) voltage regulator circuit regulating the power supply voltage to a first solid state integrated circuit comprising a timer circuit wherein said voltage regulator circuit comprises an NPN transistor, a resistor, and a Zener diode, (d) a first solid state integrated circuit comprising a timer circuit wherein said timer circuit comprises said first solid state integrated circuit, a resistor to disconnect the ignitor after a specific time period, a charging capacitor to provide the timing period of the timer circuit, a capacitor and resistor to provide a timer circuit trigger signal, and a capacitor to aid start-up of said first solid state integrated circuit at application of power, and (e) a second solid state integrated circuit comprising a switch circuit wherein said switch circuit comprises said second solid state integrated circuit of an optically-coupled triac AC switch and a light emitting diode (LED) wherein gate of said triac is driven by light beam generated by said LED, wherein a resistor limits current in the LED, and removal of DC voltage by said timer circuit from said second solid state integrated circuit deactivates said optically-coupled triac AC switch and said switch circuit is off wherein the removal and reapplication of power to the input terminals of the ignitor turn-off switch repeats the timing cycle and wherein input terminals of said ignitor turn-off switch are connected to the input terminals of said CWA, HX, and reactor-style ballasts and output terminals of said ignitor turn-off switch are connected to said ignitor and to the lamp operating circuit.

What is claimed is:

1. A turn-off switch circuit for an ignitor for use with CWA (constant wattage auto-transformer), HX (high reactance auto-transformer), and reactor-style ballasts, comprising, in combination:

(a) a constant current power supply, the constant current power supply comprising an AC power source, at least two current limiting capacitors, and a bidirectional zener diode;

(b) a full-wave bridge rectifying circuit across the AC power source for converting AC line voltage to pulsating DC voltage and for providing a constant DC current power supply, the full wave bridge rectifying circuit having input terminals, wherein a power supply voltage supplied to the full-wave bridge rectifying circuit is regulated by the bidirectional zener diode positioned across the input terminals of the full-wave bridge rectifying circuit;

(c) a voltage regulator circuit for regulating the power supply voltage to a timer circuit, the voltage regulator circuit having an NPN transistor, a resistor, and a zener diode, the timer circuit having a first solid state integrated circuit, a first resistor to disable the ignitor after a specific timing period, a charging capacitor for providing a timing period of the timer circuit, a second charging capacitor and a second resistor for providing a timer circuit trigger signal, and a third charging capacitor to aid start-up of the first solid state integrated circuit at application of power; and (d) a switch circuit having a second solid state integrated circuit, the second solid state integrated circuit including an optically-coupled triac and a light emitting diode (LED) wherein a gate of the optically-coupled triac is driven by a light beam generated by the LED, wherein a current limiting resistor limits current in the LED, and removal of the DC voltage by the timer circuit from the second solid state integrated circuit deactivates the optically-coupled triac and the switch circuit.

2. The turn-off switch circuit of claim 1, wherein removal and reapplication of the power supply voltage to the input terminals of the turn-off switch circuit repeats a timing cycle.

3. The turn-off switch circuit of claim 1 wherein the turn-off switch circuit includes input terminals and output terminals, the CWA, HX, and reactor-style ballasts include input terminals, and the input terminals of the turn-off switch circuit are connected to the input terminals of the CWA or HX or reactor-style ballasts and output terminals of the turn-off switch circuit are connected to the ignitor and to a lamp operating circuit.

* * * * *